US010774695B2

(12) United States Patent
Pribek et al.

(10) Patent No.: US 10,774,695 B2
(45) Date of Patent: Sep. 15, 2020

(54) PRESSURE MEDIUM SUPPLY TO VALVE TRAIN ELEMENTS

(71) Applicant: Schaeffler Technologies AG & Co. KG, Herzogenaurach (DE)

(72) Inventors: Michael Pribek, Uehlefeld (DE); Frank Himsel, Obermichelbach (DE); Jihnwan Jeon, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 136 days.

(21) Appl. No.: 15/904,467

(22) Filed: Feb. 26, 2018

(65) Prior Publication Data

US 2018/0298791 A1 Oct. 18, 2018

(30) Foreign Application Priority Data

Apr. 13, 2017 (DE) ..... 10 2017 108 060

(51) Int. Cl.

| | |
|---|---|
| ***F16L 9/18*** | (2006.01) |
| ***F01L 1/46*** | (2006.01) |
| ***F01L 1/24*** | (2006.01) |
| *F01L 1/18* | (2006.01) |

(52) U.S. Cl.

CPC ..... *F01L 1/46* (2013.01); *F01L 1/2405* (2013.01); *F01L 1/24* (2013.01); *F01L 2001/186* (2013.01); *F01L 2301/00* (2020.05); *F01L 2810/02* (2013.01)

(58) Field of Classification Search

CPC ..... F01L 1/46; F01L 1/24
USPC ..... 138/39, 115, 116
See application file for complete search history.

(56) References Cited

U.S. PATENT DOCUMENTS 1,379,409 A * 5/1921 Horn ..... F22G 3/004 122/459
2,390,913 A * 12/1945 Barrett ..... F02B 27/006 60/605.1
2,743,960 A * 5/1956 Kamin ..... B05B 1/20 239/266
2,840,151 A * 6/1958 Jackson ..... F23D 14/105 239/487
3,374,858 A * 3/1968 Richards ..... F16K 47/12 181/274
3,633,343 A * 1/1972 Mark ..... F01N 3/0217 96/118
3,826,479 A * 7/1974 Ikegawa ..... C21B 7/16 122/6.6
3,841,565 A * 10/1974 Buisson ..... F02K 9/52 239/488
4,159,627 A * 7/1979 Monch ..... F01N 13/10 60/322
4,596,491 A * 6/1986 Dietzler ..... E02B 11/00 405/154.1

(Continued)

FOREIGN PATENT DOCUMENTS

DE 102016208470 A1 11/2017

*Primary Examiner* — James F Hook

(57) ABSTRACT

A pipe for supplying pressure medium to valve train elements, including: an outer wall; a partition located inward of the outer wall and twisted in a spiral along the outer wall; a first gallery formed by the partition and the outer wall; a second gallery formed by the partition and the outer wall and separate from the first gallery; and a plurality of overflow openings. Each overflow opening opens to the first gallery or to the second gallery.

16 Claims, 3 Drawing Sheets

(56) References Cited

U.S. PATENT DOCUMENTS

| | | | | | |
|---|---|---|---|---|---|
| 4,747,697 | A * | 5/1988 | Kojima | B01F 5/0615 | 138/39 |
| 4,756,339 | A * | 7/1988 | Buluschek | A01G 25/02 | 138/115 |
| 4,795,439 | A * | 1/1989 | Guest | A61M 25/0009 | 138/115 |
| 5,423,488 | A * | 6/1995 | Filion | B29B 7/32 | 239/488 |
| 2001/0000327 | A1* | 4/2001 | Zittel | A23B 7/06 | 426/506 |
| 2003/0144623 | A1* | 7/2003 | Heath | A61M 25/0023 | 604/4.01 |
| 2003/0154943 | A1* | 8/2003 | Murata | F01L 1/267 | 123/90.16 |
| 2004/0244852 | A1* | 12/2004 | Cornea | F01L 1/34 | 137/625.69 |
| 2008/0302322 | A1* | 12/2008 | Edelmayer | F01L 1/181 | 123/90.39 |
| 2013/0019830 | A1* | 1/2013 | Hoppe | F01L 1/34 | 123/90.17 |
| 2017/0022848 | A1 | 1/2017 | Ahmed et al. | | |
| 2017/0284236 | A1 | 10/2017 | Ahmed et al. | | |
| 2017/0350280 | A1 | 12/2017 | Ahmed et al. | | |

* cited by examiner

PRESSURE MEDIUM SUPPLY TO VALVE TRAIN ELEMENTS

CROSS-REFERENCE TO RELATED APPLICATION

This patent application claims the benefit, under 35 U.S.C. § 119(a), of German patent application 10 2017 108 060.0 filed Apr. 13, 2017, which patent application is incorporated herein by reference.

TECHNICAL FIELD

The present disclosure relates to a pressure medium supply to valve train elements. The valve train elements are arranged in receptacle boreholes of a component of an internal combustion engine and are operationally connected to switchable valve actuating levers or to switchable support elements, with a longitudinal channel in the component of the internal combustion engine, which has at least two supply galleries by means of at least one partition wall or a pipe having at least one partition. Each receptacle borehole is connected using one overflow opening each to a supply gallery.

BACKGROUND

A pressure medium supply to valve train elements is known from commonly owned German patent application P 10 2016 208 470 (no prior publication). The partition wall or the partition in a pipe extend horizontally along a component of an internal combustion engine, so that an upper and a lower supply gallery are available. Valve train elements are designed as support elements, which are connected to switchable valve actuating levers. The support elements are connected to the upper gallery or the lower gallery, so that the valve actuating levers can be switched by variation of the pressures in the galleries. However, since the partition wall or the partition in the pipe are adjacent to the valve train elements and/or the receptacle boreholes in the component of the internal combustion engine into which the valve train elements are inserted, it is difficult to find the right dimensions for the cutting or the clearance for the receptacle boreholes. Flow connection to the galleries therefore has to be produced via boreholes below and above the partition wall or partition. The boreholes are incorporated into the cuts or the clearances in the wall of the pipe, which is expediently performed before installation of the pipe. The practical design of the flow connection between the galleries and the valve train elements is also very difficult and complex, in particular because of the tolerances.

SUMMARY

A partition wall or a partition in the pipe is embodied as twisted in a spiral along a longitudinal channel. By way of a suitable twist, which can be produced evenly or unevenly, a respective supply gallery is adjacent without obstruction by the partition or partition wall to the respective valve train element and can be connected directly to the receptacle borehole or the respective valve train element.

In an example embodiment, a flow connection between a receptacle borehole and a respective supply gallery is produced by cutting the supply gallery during the machining of the receptacle borehole or by a subsequent machining procedure. It is sufficient to form a suitable partition wall or a pipe having a partition in a spiral such that the flow connection is produced by machining the receptacle borehole. In an example embodiment, a borehole is produced in the respective supply gallery matching with the receptacle borehole before installation of the pipe. The spiral twist of the partition wall or the partition is embodied in this case such that two or three valve train elements, arranged adjacent to one another, are connected in pairs or in groups of three to the same supply gallery. By way of corresponding pressure control, switchable valve actuating levers are then switched to full stroke, partial stroke, or zero stroke. Depending on the desired design, the spiral twist also is embodied such that each two pairs or groups of three of the valve train elements are connected to the same supply gallery. The switchable valve actuating levers at cylinders 1 and 2 and also cylinders 3 and 4 are thus switched in pairs, but separately from one another. In an example embodiment, to switch the valve actuating levers of cylinders 1 and 4 and also cylinders 2 and 3 in groups. In the case of an internal combustion engine having six or more cylinders, the remaining cylinders are considered accordingly. Groups of three cylinders can also be combined.

In an example embodiment, the spiral twist is embodied such that the valve train elements are each alternately connected to another supply gallery along the longitudinal channel. As a result, for example, the switchable valve actuating levers switch the inlet or outlet valve(s) individually or in groups or switch all inlet or outlet valves of an internal combustion engine simultaneously.

For simple production of the pressure medium supply to valve train elements, method steps are proposed in which the partition wall or the partition with the pipe are installed in the longitudinal channel such that the supply galleries assume desired locations for the supply galleries. Subsequently or also previously, receptacle boreholes for the valve train elements are produced or drilled with cutting of the respective supply galleries. A cost-effective pressure medium supply device is thus producible using simple means.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
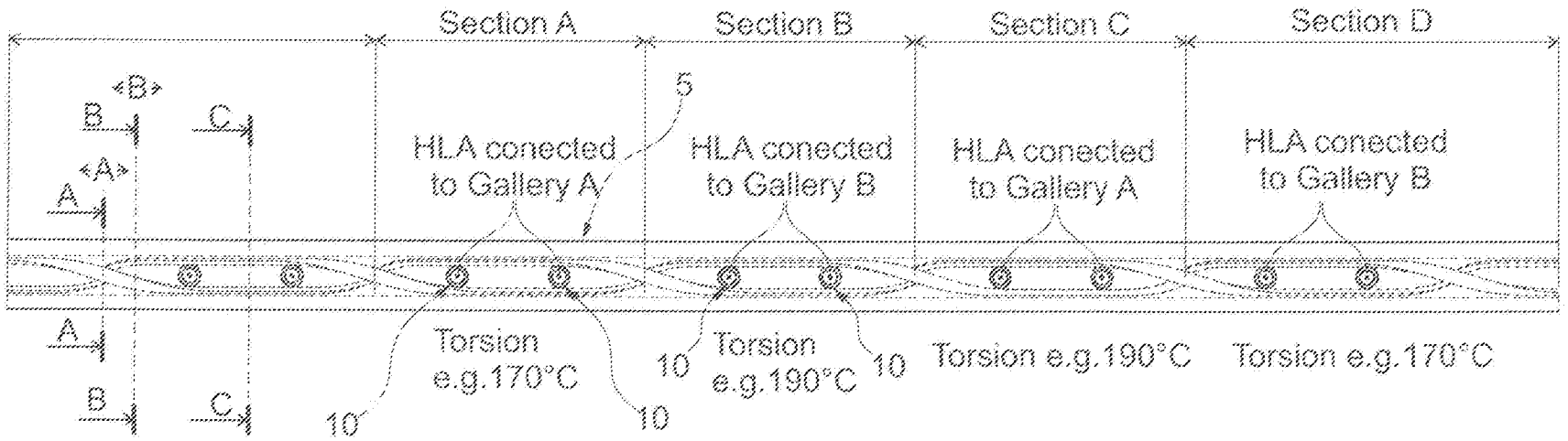
FIG. 1 shows a schematic illustration of a pipe with a spiral partition in a longitudinal channel for pressure medium supply.
Figure 5:
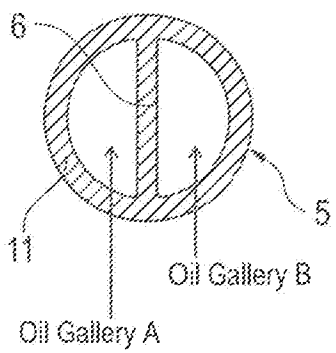
FIG. 5 shows a cross-section generally along line C-C in FIG. 1.
Figure 4:
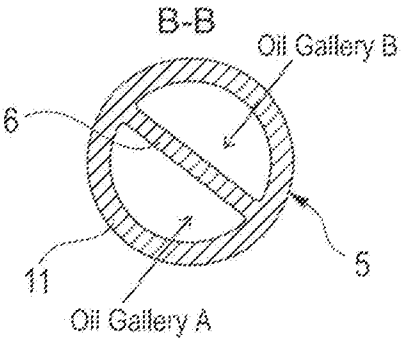
FIG. 4 shows a cross-section generally along line B-B in FIG. 1.
Figure 3:
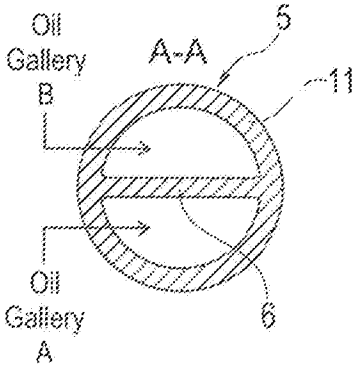
FIG. 3 shows a cross-section generally along line A-A in FIG. 1.
Figure 2:
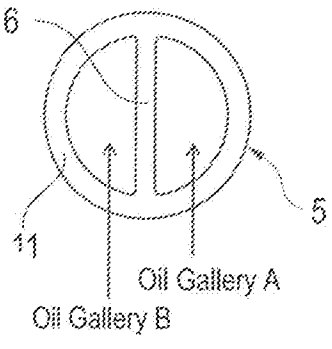
FIG. 2 shows a side view of the pipe in FIG. 1 at an end of the pipe and the beginning of the longitudinal channel.
Figures 6, 7, 8:
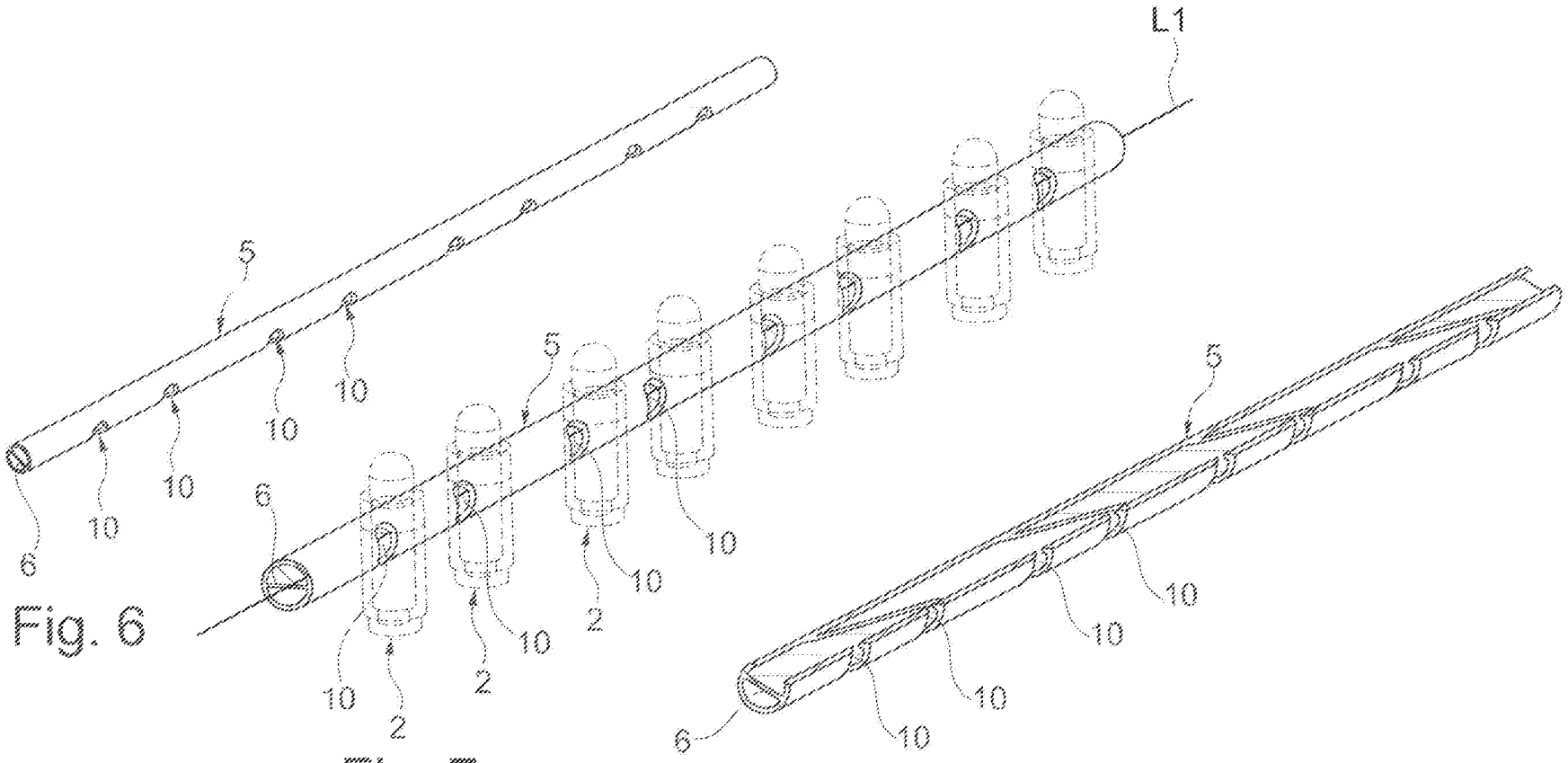
FIG. 6 shows a perspective view of a pipe having a spiral partition.
FIG. 7 shows a perspective view of a pipe corresponding to FIG. 6 with sketched valve train elements.
FIG. 8 shows a longitudinal section through a pipe having a partition corresponding to FIGS. 6 and 7.

In FIGS. 1 to 10, insofar as shown in detail, receptacle boreholes are incorporated into a component of a reciprocating piston internal combustion engine, into which boreholes valve train elements 2 are inserted. Elements 2 are designed as support elements, optionally switchable and/or having hydraulic play compensation function. Valve train elements 2 are operationally connected to simple or switchable valve actuating levers, which are in turn supported on valve train elements 2 and are operationally connected to gas exchange valves, optionally with an actuating bridge interconnected.

Along valve train elements 2, a longitudinal channel is provided, which can be cast or drilled in. According to FIGS. 1 to 8, pipe 5 including outer wall 11 and partition 6 inward of wall 11 and connected to wall 11, is installed in the longitudinal channel, so that supply galleries A and B are formed in part by partition 6. Partition 6 seals gallery A from gallery B. As seen in FIGS. 1 to 5 in particular, pipe 5 and/or partition 6 in pipe 5 are embodied as twisted in a spiral, so that valve train elements 2 are connected to supply gallery A in section A and section C (FIG. 1), while valve train elements 2 are connected to supply gallery B in sections B and D. For example, two respective overflow openings 10 are included in each of sections A, B, C, and D of pipe 5. To illustrate the twist of partition 6, in the end view of FIG. 2 and in the respective sections of FIGS. 3, 4, and 5, partition 6 is in different respective circumferential positions with respect to wall 11.

Pipe 5 having partition 6 can be produced from metal, plastic, or another suitable material and can consist of one piece or of individual parts that are assembled. Since corresponding supply galleries A and B are associated in a sufficient circumferential portion with respective associated valve train elements 2 (see FIGS. 7 and 8), the flow connections between respective supply galleries A and B and valve train elements 2 can be produced in a simple manner by cutting the respective supply gallery A or B in conjunction with the production or machining of the receptacle borehole for valve train elements 2, resulting in overflow openings 10. In example embodiment, overflow openings 10 are incorporated before the installation of pipe 5. Further, pipe 5 is sealed off in the longitudinal channel at least in the region of overflow openings 10, for which purpose at least partial machining of the longitudinal channel is advantageous.

Overflow openings 10 are aligned along pipe 5. For example, straight line L1 passes through wall 11 and every opening 10 in pipe 5.

Figures 9, 10:
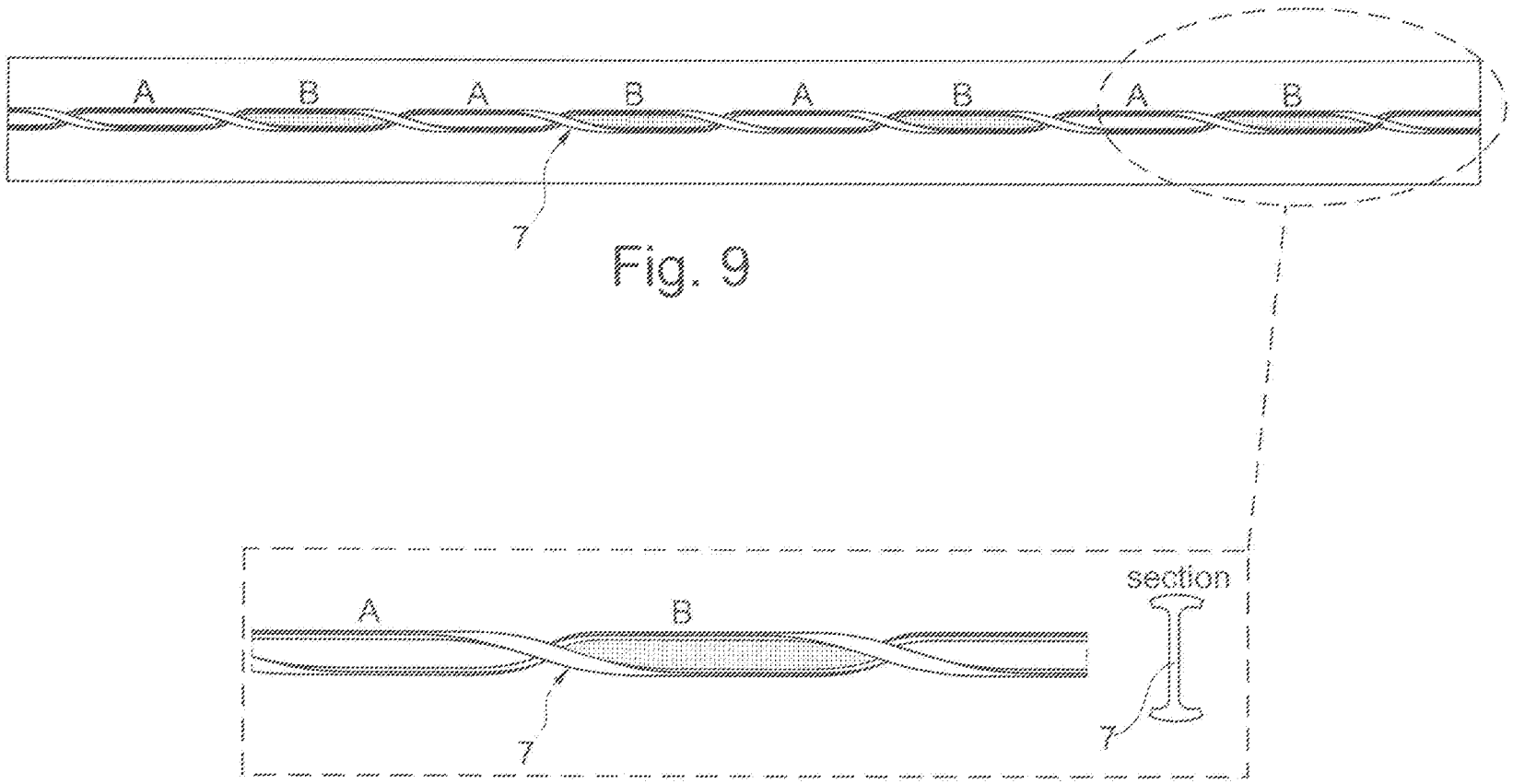
FIG. 9 shows a spiral twisted partition wall.
FIG. 10 shows a partition wall section according to the oval in FIG. 9 in an enlarged scale and a cross section through the partition wall.

In FIGS. 9 and 10, partition wall 7, which is also embodied as twisted in a spiral shape, is installed in a longitudinal channel to form a seal. Partition wall 7 has, as can be seen from the right image of FIG. 10, lateral end strips, which increase the sealing in the longitudinal channel. Partition wall 7 can also be produced from plastic, metal, or another suitable material. In the designs, according to FIGS. 9 to 10, partition wall 7 is twisted so strongly that each following valve train element 2 is connected to another supply gallery A or B, so that the supply gallery A is followed by the supply gallery B, then in turn the gallery A and again the gallery B, and this corresponds to the number of the cylinders or the number of valve train elements 2.

LIST OF REFERENCE CHARACTERS

A supply gallery
B supply gallery
L1 line
2 valve train elements
5 pipe
6 partition
7 partition wall
10 overflow openings
11 outer wall

The invention claimed is:

1. A pipe for supplying pressure medium to valve train elements, comprising:
- an outer wall;
- a partition:
  - located inward of the outer wall; and,
  - twisted in a spiral along the outer wall;
- a first gallery formed by the partition and the outer wall;
- a second gallery:
  - formed by the partition and the outer wall; and,
  - completely sealed, within the outer wall and along an entire length of the pipe, from the first gallery by the partition; and,
- a plurality of overflow openings, wherein:
  - at least one first overflow opening, included in the plurality of overflow openings, opens to the first gallery; and,
  - at least one second overflow opening, included in the plurality of overflow openings, opens to the second gallery.

2. The pipe of claim 1, wherein every overflow opening in the pipe is aligned along the pipe.

3. The pipe of claim 1, wherein a straight line passes through every overflow opening in the pipe.

4. The pipe of claim 1, wherein:
- a first section of the pipe includes at least one first overflow opening, included in the plurality of overflow openings, open to the first gallery;
- a second section of the pipe includes at least one second overflow opening, included in the plurality of overflow openings, open to the second gallery;
- a third section of the pipe includes at least one third overflow opening, included in the plurality of overflow openings, open to the first gallery; and,
- the second section of the pipe is located between the first section of the pipe and the third section of the pipe.

5. The pipe of claim 1, wherein:
- a first section of the pipe includes a first overflow opening and a second overflow opening, each open to the first gallery;
- a second section of the pipe includes a third overflow opening and a fourth overflow opening, each open to the second gallery;
- a third section of the pipe includes a fifth overflow opening and a sixth overflow opening, each open to the first gallery; and,
- the second section of the pipe is located between the first section of the pipe and the third section of the pipe.

6. The pipe of claim 1, wherein:
- at a first cross-section of the pipe, the partition is in a first circumferential position with respect to the outer wall; and,
- at a second cross-section of the pipe, the partition is in a second circumferential position, different from the first circumferential position, with respect to the outer wall.

7. The pipe of claim 1, wherein each overflow opening in the plurality of overflow openings is arranged to connect to a respective valve train element.

8. A method of operating the pipe of claim 1, comprising:

flowing the pressure medium through the first gallery and a first overflow opening, included in the plurality of overflow openings; and, flowing the pressure medium through the second gallery and a second overflow opening, included in the plurality of overflow openings.

9. A pipe for supplying pressure medium, comprising:

an outer wall;

a partition:

located inward of the outer wall; and, connected to the outer wall;

a first gallery formed by the partition and the outer wall;

a second gallery:

formed by the partition and the outer wall; and, completely sealed from the first gallery by the partition;

a first plurality of overflow openings open to the first gallery; and, a second plurality of overflow openings open to the second gallery, wherein:

a straight line passes through the outer wall and:

every overflow opening in the first plurality of overflow openings; and, every overflow opening in the second plurality of overflow openings;

the first plurality of overflow openings is arranged to supply a pressure medium to a first plurality of valve train elements of an internal combustion engine; and, the second plurality of overflow openings is arranged to supply the pressure medium to a second plurality of valve train elements of the internal combustion engine.

10. The pipe of claim 9, wherein the partition is twisted in a spiral along the outer wall.

11. The pipe of claim 9, wherein every overflow opening in the pipe is included in:

the first plurality of overflow openings; or, the second plurality of overflow openings.

12. The pipe of claim 9, wherein:

a first section of the pipe includes at least one first overflow opening, included in the first plurality of overflow openings, open to the first gallery;

a second section of the pipe includes at least one second overflow opening, included in the second plurality of overflow openings, open to the second gallery;

a third section of the pipe includes at least one third overflow opening, included in the first plurality of overflow openings, open to the first gallery; and, the second section of the pipe is located between the first section of the pipe and the third section of the pipe.

13. The pipe of claim 9, wherein:

a first section of the pipe includes a first overflow opening and a second overflow opening, each open to the first gallery;

a second section of the pipe includes a third overflow opening and a fourth overflow opening, each open to the second gallery;

a third section of the pipe includes a fifth overflow opening and a sixth overflow opening, each open to the first gallery; and, the second section of the pipe is located between the first section of the pipe and the third section of the pipe.

14. The pipe of claim 9, wherein:

at a first cross-section of the pipe, the partition is in a first circumferential position with respect to the outer wall; and, at a second cross-section of the pipe, the partition is in a second circumferential position, different from the first circumferential position, with respect to the outer wall.

15. A method of operating the pipe of claim 9, comprising:

flowing the pressure medium through the first gallery and the first plurality of overflow openings; and, flowing the pressure medium through the second gallery and the second plurality of overflow openings.

16. A pipe for supplying pressure medium, comprising:

an outer wall;

a partition:

located inward of the outer wall; and, twisted in a spiral along the outer wall;

a first gallery formed by the partition and the outer wall;

a second gallery:

formed by the partition and the outer wall; and, sealed from the first gallery by the partition;

a plurality of first pairs of overflow openings in the outer wall and open to the first gallery; and, a plurality of second pairs of overflow openings in the outer wall and open to the second gallery, wherein:

the first pairs of overflow openings alternate with the second pairs of overflow openings along the outer wall;

the plurality of first pairs of overflow openings is arranged to provide the pressure medium to switch a first plurality of drive train elements of an internal combustion engine;

the plurality of second pairs of overflow openings is arranged to provide the pressure medium to switch a second plurality of drive train elements of the internal combustion engine; and, the pipe is arranged, via pressure control, to switch the first plurality of drive train element separately from the second plurality of drive train elements.

* * * * *